US005755400A

United States Patent [19]

Kalms, III

[11] Patent Number: 5,755,400

[45] Date of Patent: May 26, 1998

[54] INERTIAL INSTRUMENTATION CORRECTION TECHNIQUE

[75] Inventor: William Kalms, III, Acton, Mass.

[73] Assignee: Raytheon Company, Lexington, Mass.

[21] Appl. No.: 194,328

[22] Filed: Oct. 2, 1980

[51] Int. Cl.[6] ..... F41G 7/34

[52] U.S. Cl. ..... 244/3.17

[58] Field of Search ..... 244/3.17, 3.19; 343/5 MM

[56] References Cited

U.S. PATENT DOCUMENTS

| | | | |
|---|---|---|---|
| 3,421,716 | 1/1969 | Altekruse et al. | 244/3.17 |
| 3,879,728 | 4/1975 | Wolff | 343/5 MM |
| 4,163,231 | 7/1979 | Zuerndorfer et al. | 343/5 MM |

OTHER PUBLICATIONS

Novak, "Correlation Algorithms for Radar Map Matching" IEEE Transactions on Aerospace & Electronics Systems; vol. AES-14, #4, 1978.

*Primary Examiner*—Charles T. Jordan
*Attorney, Agent, or Firm*—Donald F. Mofford

[57] ABSTRACT

A technique for deriving correction signals for inertial instruments on a missile, such as an intercontinental ballistic or a cruise missile, is shown to include: a radar operative in a synthetic aperture mode when the missile approaches a predetermined area containing at least three separate fixed terrain features whose radar signatures (as observed from a preselected position) have been predetermined and stored on the missile; successively illuminating each one of such features and comparing the actual radar signals with the stored radar signatures; and deriving correction signals for the inertial instruments in accordance with the difference between the actual and stored radar signals.

2 Claims, 6 Drawing Sheets

HEAT SHIELD 83
BORON NITRIDE WINDOW 85
STRUCTURAL SHELL 103
DIRECTIONAL COUPLER 97
PHASE SHIFTERS 93
STRIPLINE SERIES FEED 95
COVER PLATE 101
CORPORATE STRIPLINE FEED BOARD 99

INERTIAL INSTRUMENTATION CORRECTION TECHNIQUE

The Government has rights in this invention pursuant to Contract No. F04701-76-C-0002 awarded by the Department of the Air Force.

BACKGROUND OF THE INVENTION

This invention pertains generally to navigation systems and particularly to any system of such type wherein radar data is utilized to periodically update and correct inertial instruments.

It is known that vehicles such as aircraft and missiles which must traverse relatively large distances rely on inertial platforms for navigation purposes. Unfortunately, inertial platforms are subject to long-term drift errors, which unless corrected, will result in concomitant navigation errors. Thus, for example, some aircraft employ Doppler radars to measure the aircraft velocity and subsequently use these measurements to upgrade the velocity estimates obtained from the inertial platform. Also, accurate aircraft position data may be obtained by means of a network of control towers and/or radio frequency (R.F.) beacons.

While such navigation aids are readily available to commercial aircraft, with regard to military aircraft and/or missiles, a different situation will obtain. That is to say, military aircraft penetrating enemy territory will not be provided with ground beacons for the purposes of obtaining accurate position data. Furthermore, such aircraft may be forced to take evasive maneuvers which only serve to compound the navigation problem.

In the case of missiles, particularly in regard to cruise missiles, which have necessarily long flight times, the errors associated with inertial navigation could build to such a degree that the kill probability of a single missile against a given target would be reduced to such an extent that several missiles would, perforce, have to be assigned to that particular target. The navigational errors associated with ballistic missiles, on the other hand, has led to the use of high yield warheads to increase the kill probability against a given target which results in a concomitant high degree of damage to the surrounding area.

SUMMARY OF THE INVENTION

With this background of the invention in mind, it is a primary object of this invention to provide a precision, all-weather, terminal navigation aid suitable for use on both ballistic and cruise missiles as well as on aircraft.

This and other objects of this invention are attained by providing on board the vehicle a pulse Doppler radar operating in a synthetic aperture mode. The navigation updating is based on the in-flight radar detection of one or more unique terrain features whose location in inertial coordinates is precisely known. The terrain features must comprise an adequate radar target which requires that they be a boundary between high and low reflectivity surfaces and that they have a unique shape among all the other features surrounding it. The inertial coordinates and the shape of the reference terrain feature are transformed into range and Doppler coordinates and are stored in a signal processor on board the vehicle prior to launch. The pulse Doppler radar illuminates the ground area surrounding the preselected feature and resolves this area into range and Doppler coordinates. The radar map is correlated against the stored reference map using an edge correlation process. Once correlation is achieved, the range and range rate to that terrain feature are precisely known. Three sequential correlations against three selected terrain features are performed, thereby precisely determining three components of vehicle velocity and three components of vehicle position which are subsequently used to update the navigation computer for position and velocity to correct any inertial errors.

BRIEF DESCRIPTION OF THE DRAWINGS

For a more complete understanding of this invention, reference is now made to the following description of the accompanying drawings, wherein.

DESCRIPTION OF THE PREFERRED EMBODIMENT

Figure 1:
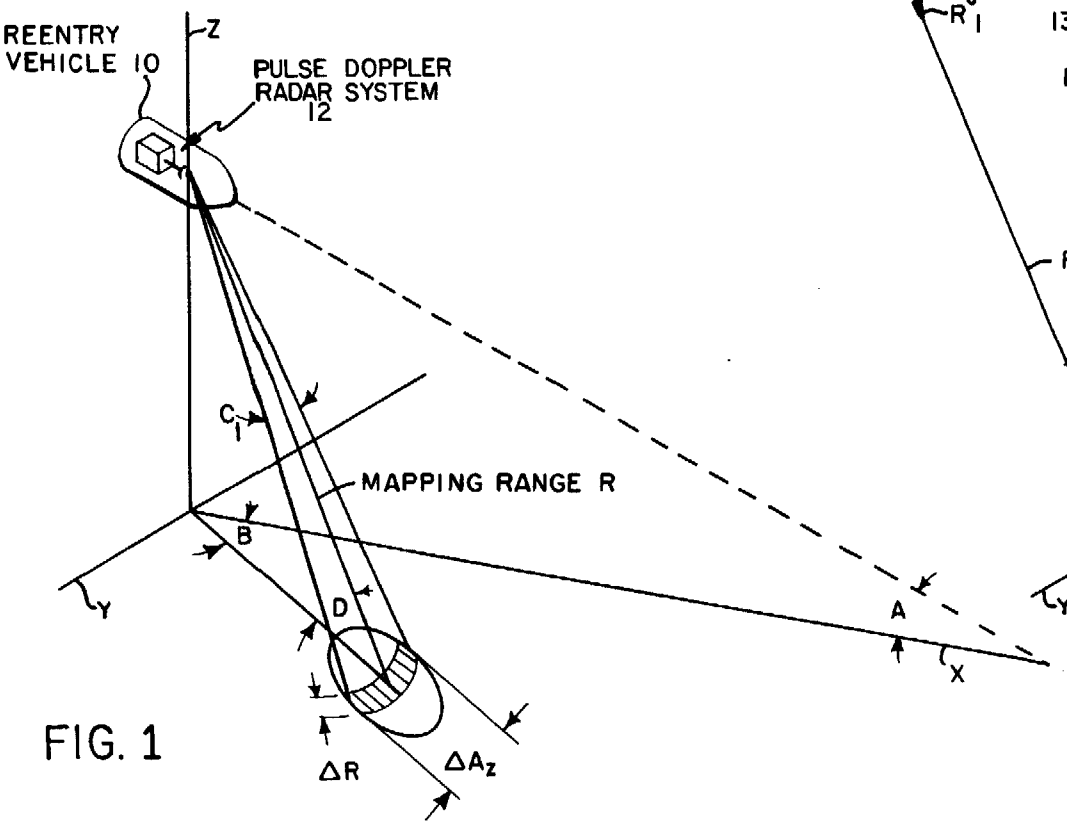
FIG. 1 is a sketch illustrating how a pulse Doppler radar would be operated according to the invention.

Referring now to FIG. 1, a moving platform which may, for example, be a reentry vehicle 10 and which is equipped with a pulse Doppler synthetic aperture radar 12 is shown to illuminate a plurality of fixed points (not numbered) on the ground. The azimuth extent, ΔAz, of the illuminated area can be large, depending on the mapping range, R. Thus, for example, consider a one foot aperture radar operating at an X-band frequency and yielding a beam width of 0.1 radians. At a range, R, of 5,000 feet (5K ft.), the azimuth extent, ΔAz, is approximately 500 feet while at a range, R, of 50K ft. the azimuth extent, ΔAz, is approximately 5K ft. At exo-atmospheric altitudes, the range, R, is in the order of 500K ft., and the resulting azimuth extent, ΔAz, could be as large as 50K ft.

From the foregoing it should now be appreciated that the azimuth extent, ΔAz, is range dependent and this dependency would restrict radar operation of altitudes of, say, below 50K ft. In order to improve the azimuth resolution by making that parameter effectively independent of mapping range, R, the herein contemplated radar system 12 employs Doppler processing of the radar return signals. The Doppler processing is based on the fact that the phase of each transmitted signal here is a systematically time-varying quantity. The phase difference between the transmitted and received signals is constant (corresponding to a constant time delay between transmitted and received signals) if the radar and target are stationary. If, however, the radar path length changes with time because of relatively radial movement between the radar and target, the phase difference between the transmitted and received signals will also change to reflect such a time-varying change. Thus, the pulse Doppler radar system 12 measures and records the phase and amplitude of the energy returned from the plurality of fixed points (not numbered) located within a given range bin. In turn, after a sufficient number of samples have been obtained, the recorded signals are spectrum-analyzed, thereby providing a means of differentiating between elements lying within the illuminated area of the radar 12.

As is known, the additional mapping dimension due to Doppler processing creates a grid (not shown) on the ground defined by the intersections of constant range spheres (not shown) and the loci of points whose radar returns exhibit constant Doppler velocity characteristics (isodops). It can be shown that the range resolution, $\Delta R$, in the resulting grid (not shown) is given by:

$$\Delta R = c\tau/2 \cos D \quad (1)$$

where c is the velocity of light, $\tau$ is the transmitted pulse-width (or, equivalently, the reciprocal of the transmitted bandwidth, and D is the radar beam depression angle. Similarly, it may be shown that the azimuth resolution, $\Delta Az$, is given by:

$$\Delta Az = \lambda RK/2VT_i \sin B \cos A \quad (2)$$

where $\lambda$ is the wavelength of the transmitted energy, K is a resolution broadening factor to account for a weighting function applied over the integration time to control the Doppler filter sidelobes, $T_i$ is the integration time over which the spectrum analysis is performed. B is the ground plane projection of the squint angle, A is the re-entry angle, and V is the re-entry vehicle velocity.

Figure 2:
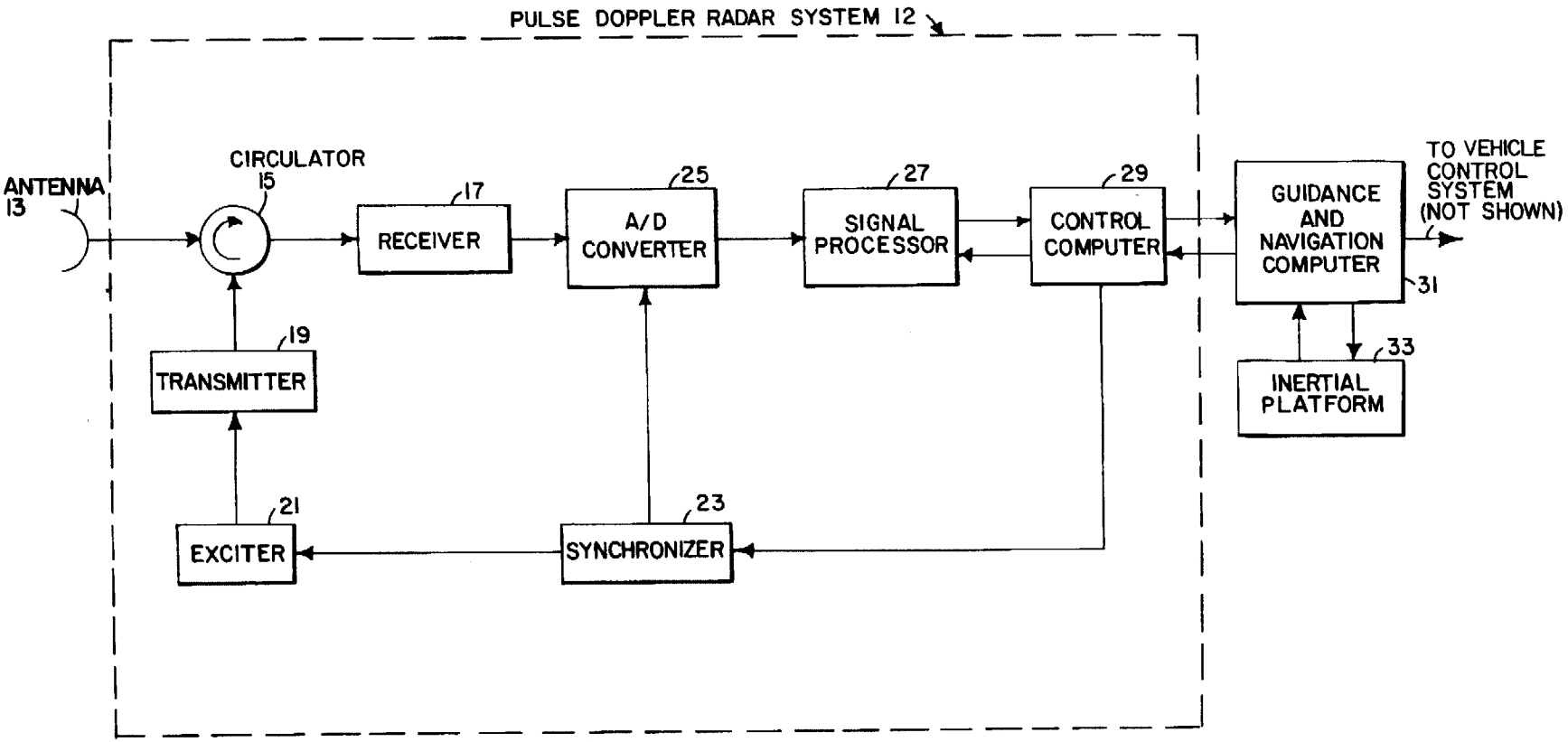
FIG. 2 is a generalized block diagram of the pulse Doppler radar system of FIG. 1.

Referring now to FIG. 2, the pulse Doppler radar system 12 is shown to include an antenna 13 which will be described in detail hereinbelow. Suffice it to say here that the latter must have sufficient steering ability to be able to cover the required search region and to be able to make up any lack of precise vehicle attitude control. The antenna 13 is connected, via a circulator 15, to a receiver 17 and a transmitter 19. The latter is here of conventional design and may, for example, use a traveling wave tube (TWT) amplifier controlled by an exciter 21 which, in turn, is controlled by a synchronizer 23. The exciter 21 is of conventional design and develops (at low power levels) the transmitted pulse waveforms in response to gate signals supplied by the synchronizer 23.

The receiver 17 is also of conventional design and serves to amplify and down-convert all received signals to base-band video in-phase (I) and quadrature phase (Q) signals. Automatic gain control (AGC) is provided within the receiver 17 to match the signal dynamic range to the dynamic range of the signal processor 27. The coherent video I and Q output signals from the receiver 17 are digitized by an analog-to-digital (A/D) converter 25 at a rate of one complex word (pair of I and Q samples) per range gate per transmitted pulse prior to being passed to a digital signal processor 27. The timing of the A/D converter 25 is controlled by the synchronizer 23 and is effective to shift the range gates (not shown) in time so as to stabilize their relative positions on the ground as the vehicle 10 (FIG. 1) moves during the coherent dwell period, thereby providing the so-called "range-slip" adjustment.

The digital signal processor 27 is of conventional design and performs the functions of (a) weighting to control the Doppler sidelobes of the return signals, (b) complex multiplication to provide a time-varying Doppler offset to shift and hold the ground return Dopplers within the instrumented Doppler filter bandwidth, (c) a time-varying phase shift to compensate for phase modulations induced by vehicle vibrations and other high frequency random motions, and (d) an averaging of the first several range sweep sets of samples to provide for PRF and receiver gain adjustments. The thus-modified signal samples are stored in a data memory (not shown) for the duration of the coherent swell. After the dwell is complete, the samples are read out, one range gate at a time, from the data memory (not shown) and are processed through a Fast Fourier Transform (FFT) signal processor (also not shown) to develop the Doppler resolution. The resulting sensed map in range and Doppler coordinates is searched for a map match with the stored reference map in a manner to be described in detail hereinbelow. The coordinate values for the resulting match point are determined and passed to a control computer 29 wherein it is subsequently used in the navigation up-dating process.

The control computer 29 provides the basic control for the radar system 12 and provides an interface with the vehicle guidance and navigation computer 31 and, via the latter, with the inertial platform 33. The control computer 29 generates the commands for operating the radar system 12 which include the radar timing sequences, the operating frequency, the pulse length, pulse repetition rate, as well as the antenna beam pointing commands. The latter are computed based on the vehicles position and attitude measurements obtained from the inertial platform 33, via the guidance and navigation computer 31. The requisite range slip, Doppler offset, and Doppler focus commands are determined by the control computer 29 based on the vehicle velocity measurements obtained from the inertial platform 33.

Position and velocity updating are performed in the control computer 29 using the measured fix data from the digital signal processor 27 (FIG. 2). Position and velocity updates are provided by the control computer 29 to the guidance and navigation computer 31 at the end of three fix-taking operations. It should be noted here that attitude estimates from the guidance and navigation computer 31 are required by the control computer 29 to permit the antenna pointing commands to be computed in body fixed coordinates. Since, as will be explained in detail hereinbelow, part of the antenna beam pointing is accomplished by reorienting the vehicle 10 (FIG. 1), attitude positioning commands are also sent to the guidance and navigation computer 31 by the control computer 29. As in the herein-contemplated system, attitude stabilization is provided by the vehicle 10 (FIG. 1) after the attitude reorientation and attitude rate measurements have been utilized by the control computer 29.

In operation, the guidance and navigation computer 31 provides a command to the vehicle control system (not shown) to position the vehicle 10 (FIG. 1) in a predetermined attitude with respect to an earth-fixed coordinate system such that the antenna 13 may scan to locate the preselected reference area or fix point. Antenna beam scanning is provided to compensate for any residual error in the attitude of the vehicle 10 (FIG. 1). The radar system 12 is commanded to start transmitting only after sufficient time has elapsed for the vehicle 10 (FIG. 1) to have stabilized at the commanded attitude. The antenna beam is subsequently scanned through the required search pattern to locate the referenced area or fix point. The radar system 12 dwells for a coherent integration interval at each beam position. A predetermined beam pointing direction for each beam in earth-fixed coordinates is computed from a knowledge of the vehicle trajectory stored in the control computer 29. The beam pointing directions together with real time vehicle attitude measurements are used to compute the beam positioning commands.

A train of coherent pulses is transmitted for each beam dwell to permit the region illuminated by the antenna beam to be mapped in range and Doppler. As mentioned hereinabove, the pulse width is set to provide the desired range resolution and the coherent dwell time is set to provide the corresponding Doppler resolution. The pulse repetition rate (PRF) is constrained by the necessity of keeping range and Doppler ambiguities outside of the area illuminated by the antenna beam. Thus, the PRF must be made higher than the Doppler extent of the terrain illuminated by the main beam to avoid having returns from adjacent ambiguous regions superimposed in the form of ghosts on the desired mapped region. The pulse width and nominal coherent dwell time are predetermined for each beam position in each reference area search pattern. The nominal PRF is also predetermined but is adjusted to a final value at the start of each coherent dwell in order to align the unambiguous range with the illuminated ground returns. That is to say, the unambiguous range interval will not initially bracket the illuminated range extent of the ground since there is initial uncertainty in the vehicle attitude and in the beam pointing direction. Thus, the PRF interval will be misaligned with the ground returns, thereby causing a folding of the returns and an eclipsing of a portion of the transmitted pulse time. Adjusting the PRF by a small amount permits the PRF interval to be aligned with the ground returns and further allows the resolution of the range ambiguity.

Digressing now for a moment, the map matching algorithm used to achieve correlation between the stored reference maps and the radar generated map within the digital signal processor 27 will now be outlined. Such a map matching algorithm is described in detail in an article entitled, "Correlation Algorithms for Radar Map Matching," by L. Novak, 1976 Proceedings of the IEEE Conference on Decision and Control, IEEE Publication No. 76CH1150-2. Suffice it to say here that the requisite correlation is achieved by matching radar features consisting of edges or boundaries having sufficient radar contrast as, for example, land/water boundaries or tree/field boundaries. Since edge correlation is essentially a shape detection process, construction of a reference map is simple, involving merely the construction of a pair of templates corresponding in shape with the selected edge contour.

Figure 3:
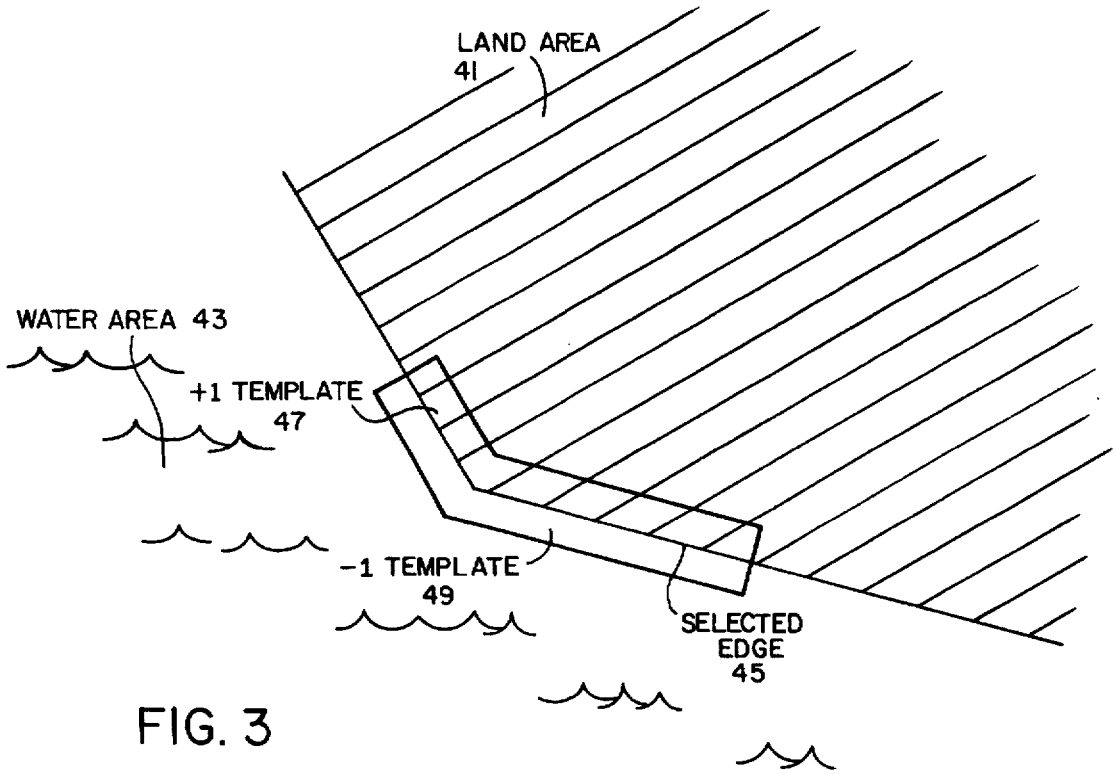
FIG. 3 is a sketch illustrating how map matching is accomplished.

Referring now to FIG. 3, the concept of edge correlation is illustrated by a simple example. Thus, the boundary between a land area 41 and a water area 43 provides a selected edge 45. That is to say, since the reflectivity of the land area 41 is considerably higher than that of the water area 43, a sharp change in brightness or contrast levels exists between the two areas. It should now be appreciated that, if an appropriately shaped template is placed over the edge 45, the latter may be detected (located) by a comparison of the average return from the brighter side of the edge (the +1 template 47) with the average return from the dimmer side of the edge (the −1 template 49). Clearly, correlation (or comparison) is best when the templates 47, 49 are located as shown. The effect of scene scintillation resulting from the single look radar data is minimized by averaging a sufficient number of cells (not shown) along each side of the selected edge 45 before making the comparison. Unambiguous detection is assured by the selection of a uniquely shaped edge contour having a sufficiently high contrast ratio within the scene search area.

As mentioned hereinabove, the prime requirement for a terrain feature to serve as a reference area or fix point is that there be a boundary between high and low reflectivity surfaces with a unique shape differing from the shape of all the other nearby terrain features. Any unique edge will serve as a radar target as long as the reflectivity across its boundary changes by 5 dB or more. Thus, the detailed radar characteristics of the illuminated area need not be known beforehand; so long as it is known beforehand that one side of the edge is "brighter" than the other side, the edge will suffice.

The edges to be used in any situation are selected from reconnaissance photography while the reference maps in range and Doppler coordinates are computer-generated from digitized records of the selected boundaries. It is noted here in passing that, since the location of any selected edge is precisely known in inertial coordinates, the transformation of the reference map into range and Doppler coordinates requires that approximate position and velocity of the vehicle 10 (FIG. 1) at the time of the fix be known in advance. As mentioned hereinabove, such information is available from trajectory programs of the vehicle 10 (FIG. 1).

The shapes of the edges representing the selected fix point are encoded as the stored reference or template. The edge detector algorithm then shifts this reference map or template across the radar generated map, cell by cell, and computes, for each shift, first, the sum of the sensed map cell intensities along the bright side of the reference edge, second, the sum of the cell intensities along the dark side of the reference edge, and finally, the quotient of these two sums. This process yields a score, the value of which is large when the match with the reference is good and is small when the match is poor. The algorithm has the property that a threshold can be associated with the particular reference geometry which allows cells with poor match scores to be rejected directly. The results of the map matching process are the coordinates of the reference area or fix point in range and Doppler. A fractional cell interpolation is utilized to further refine the estimates of range and Doppler to within a fraction of a cell.

The measured values of range and Doppler obtained from each fix-taking operation are used to refine or update the on-board estimation of vehicle position and velocity. In the mechanization of this updating process, the estimated trajectory parameters (vehicle position and velocity) are obtained from the guidance and navigation computer 31 as functions of time and are stored for the period of time during which the radar mapping or fix-taking operations are performed. When a fix measurement is available from the radar system 12, the time of that measurement is used to retrieve the corresponding trajectory parameter estimates for that time from data storage within the guidance and navigation computer 31. These estimates are then combined with the measured fix data and the known coordinates of the fix point to produce an updated trajectory estimate in a Kalman filter process within the control computer 29 (FIG. 2). This updated trajectory estimate is advanced to the current time using the stored time history of the trajectory parameter estimates based on the inertial data available to the guidance and navigation computer 31 (FIG. 2) from the inertial platform 33 (FIG. 2).

The updating of the position and velocity of the vehicle 10 (FIG. 1) after each fix-taking allows the required search region for the next fix point to be recomputed and, in general, reduced in size from what it would have to be in the absence of the previous fix measurements. By thereby reducing the requisite search region, the antenna beam scan pattern can be reduced and therefore the number of beam dwells required for completing the next fix is reduced.

Finally, it should be noted here that the search for the fix or reference point must ultimately encompass all of the uncertainty region determined by the vehicle position and velocity uncertainty. That is, the search must be made over the total sensed map produced by the set of beams utilized in covering the search pattern. Rather than assembling the set of sensed maps obtained on the complete set of beams into a large mosaic and searching over the resulting large map with the reference map or template, it is more practical separately to search the sensed map produced by each beam. This is so because the varying antenna illumination intensity over the antenna beamwidth, together with the lack of precise alignment between the radar range and Doppler coordinates at the beam edges, would otherwise create artificial jumps in map intensity at the joints in a mosaic which would interfere with the map matching process. Map processing and correlation with the stored reference is performed as the vehicle 10 (FIG. 1) is repositioned for mapping the next fix or reference point.

The range and Doppler coordinates of each of three separate fix or reference points are obtained and, on the basis of the well-known trilateration technique, the position and velocity of the vehicle 10 (FIG. 1) are accurately determined. The selection of the fix or reference points is based not only on the correlation requirements (boundary between high and low reflectivity surfaces having a unique shape among all the other features surrounding it) but also on the relative geometry between the vehicle 10 (FIG. 1), the desired target (not shown), and the reference sites. It is noted here that the use of remote reference sites offers a countermeasure advantage in that the radar system 12 (FIG. 1) never "looks" at the intended target area.

A moment's thought here now should make it clear that the ideal trilateration would involve the simultaneous measurement of the range and Doppler coordinates of three separate, orthogonal reference sites, which are widely spaced from the plane containing the flight path of the vehicle 10 (FIG. 1), relative to a single vehicle position in space. Such a simultanuity would, however, yield high fix-taking accuracy at the expense of complex radar hardware and high data processing loads to accomplish the fix calculations.

Figure 4:
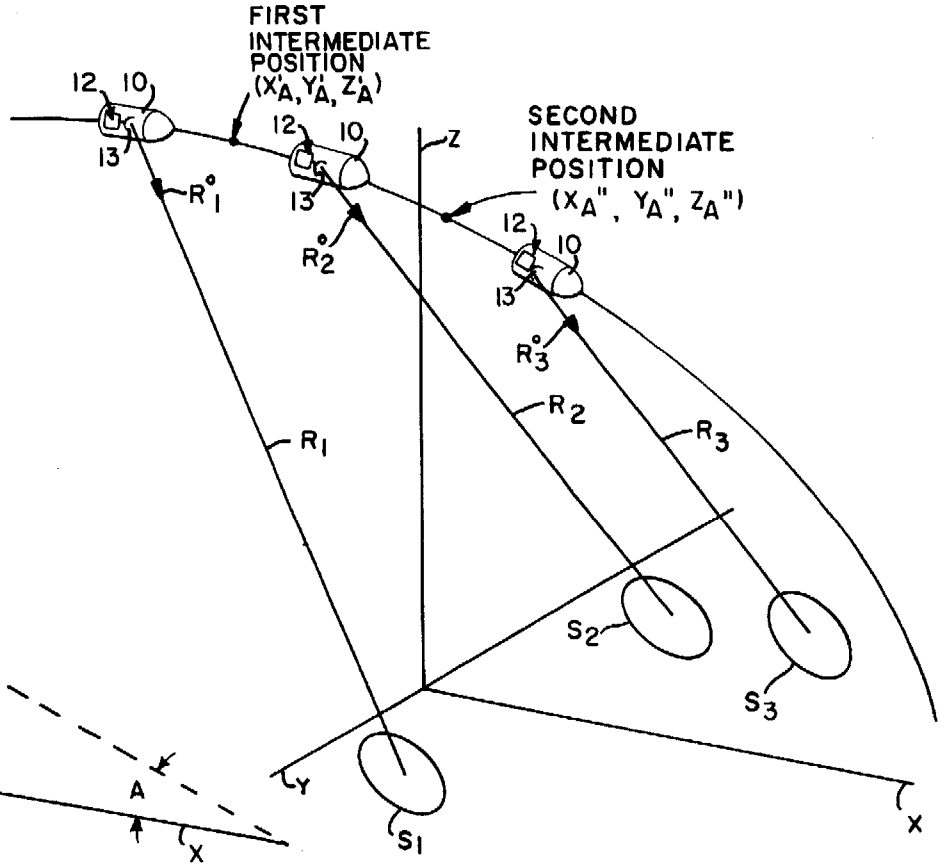
FIG. 4 is a sketch illustrating how the contemplated trilateration technique is to be implemented.

Referring now to FIG. 4, the herein contemplated pulse Doppler radar system 12 is shown to operate in a time-spaced trilateration mode wherein a single antenna 13 is utilized for the mapping function and the vehicle 10 is maneuvered to point the antenna 13 sequentially to each of three reference sites S1, S2, and S3. As each of the latter is illuminated over the requisite signal integration period, the processed data is stored within the digital signal processor 27 (FIG. 2). While the vehicle 10 is maneuvered to position the antenna 13 in the direction of the second reference site S2, the data obtained from reference site S1 are processed and correlated, as explained hereinabove, to obtain the range, $R_1$, and Doppler or range rate, $R_1$, to the first reference site S1. As a result of this processing, an intermediate guidance position ($X_A^1$, $Y_A^1$, $Z_A^1$) is determined. Likewise, as the vehicle 10 maneuvers to direct the antenna 13 to the third reference site S3, a second intermediate guidance position ($X_A^{11}$, $Y_A^{11}$, $Z_A^{11}$) is determined. The intermediate fixes reduce the area of uncertainty which must be mapped for subsequent reference areas or fix points and the system thus lends itself to the notion of "graceful degradation." That is to say, after each mapping process, at least one dimension of the uncertainty in the position of the vehicle 10 is substantially reduced. Consequently, guidance accuracy is improved on the basis of a single measurement alone.

In ballistic missile applications, the contemplated pulse Doppler radar system 12 with some modifications (to be described in detail hereinbelow) is suitable for use in exo-atmospheric (meaning altitudes below 800K ft. and above 300K ft.) or endo-atmospheric (meaning altitudes below 30K ft. and above 5K ft.) guidance updating. It should be noted here that the azimuth extent of the radar beam can be large depending on the mapping range, R. Thus, consider a 1 ft. aperture radar operating at X-band and yielding a beam width of 0.1 radians. At a range, R, of 5,000 ft. (5K ft.) the azimuth resolution is 500 ft. while at a range of 50K ft., the resolution is 5K ft. At exo-atmospheric altitudes, the range, R, is in the order of 500K ft. and the resulting azimuth resolution could be as large as 50K ft. The herein contemplated pulse Doppler radar navigation system 12 must be capable of providing either exo-atmospheric or endo-atmospheric fixes and, therefore, a different antenna is required for each of the forementioned modes.

Before proceeding, it should be noted here that, since the exo-atmospheric fix-taking sequence operates over a 150K ft. change in altitude, that sequence is not seriously constrained by the time available to search the area of uncertainty and, therefore, the aperture of the exo-atmospheric antenna should be made as large as possible in order to minimize the clutter-to-signal ratio in poor weather and reduce the transmitter power requirements. From the foregoing considerations, a 6 ft. diameter antenna is deemed to be optimum. Obviously, a 6 ft. diameter rigid antenna may not be stored within the re-entry vehicle 10 and, therefore, a stowed, unfurlable antenna is required. The primary considerations involved in the choice of such an antenna are its expanded-to-stowed volume ratio, its ease of expansion, its weight, and its rigidity after deployment.

Two types of antennas may be considered for this application: the first being an unfurlable parabolic antenna wherein energy for unfurling is stowed in spring loaded ribs which support a parabolic mesh reflecting surface in its unfurled state, and the second being an inflatable Cassegrainian antenna. Considering the fact that, in the exo-atmospheric application, the operating environment of the antenna is essentially that of a vacuum and that the antenna must operate only for a few seconds, the inflatable Cassegrainian antenna design is preferable because it requires less packaging volume and is lighter in weights. Further, a thin membrane type antenna in a vacuum which is inflated by a very small positive pressure capitalizes on the short life requirement while providing the requisite structural integrity.

Figure 5B:
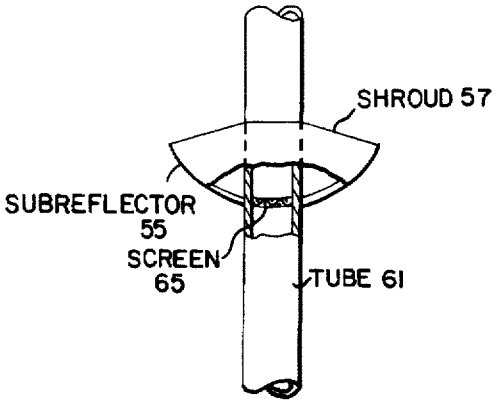
FIGS. 5A, 5B and 5C show an antenna for exo-atmospheric operation of the contemplated pulse Doppler radar system.
Figure 5C:
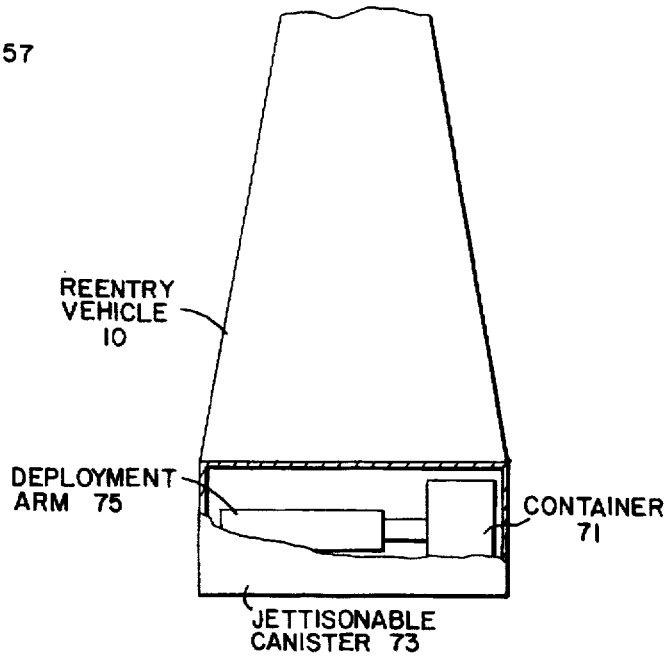
Figure 5A:
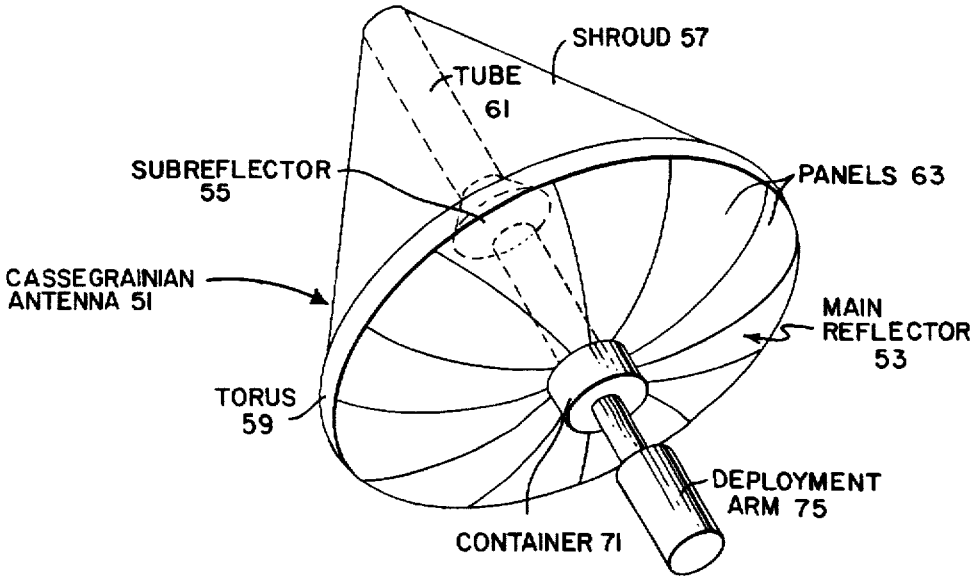

Referring now to FIGS. 5A to 5C, the herein contemplated inflatable Cassegrainian antenna 51 (sometimes hereinafter referred to simply as antenna 51), which is similar to other inflatable antennas designed for space applications by the G. T. Schjeldahl Company, Northfield, Minn., is shown to include a parabolic main reflector 53, a hyperbolic sub-reflector 55, and a truncated conical shroud 57. The parabolic main reflector 53 and the truncated conical shroud 57 are supported by an annular torus 59 provided at the intersection between the former. The hyperbolic sub-reflector 55 as well as the truncated conical shroud 57 are supported by a cylindrical tube 61. The annular torus 59 and the cylindrical tube 61 are both fabricated from 2 nil mylar pressurized at 1.5 psi. The truncated conical shroud 57, on the other hand, comprises a 0.5 nil layer of mylar (formed by bonding two 0.25 mil layers of mylar) pressurized at 0.02 psi. It should be noted here that the annular torus 59, the cylindrical tube 61, and the truncated conical shroud 57 are all transparent to radio frequency (R.F.) energy. The parabolic main reflector 53 comprises a plurality (here 18) of thermoformed panels 63, each of the latter being formed by bonding together two one-quarter mil thick pieces of mylar which have 2500 Å of aluminum vapor deposited on their inner surfaces. The sub-reflector 55 also comprises sections (not shown) of aluminum-deposited mylar, with the exception that a small circular screen 65 is provided at the center of the sub-reflector 55 to allow the 1.5 psi gas to pass therethrough and inflate the cylindrical tube 61. Similar to the parabolic reflector 53, the hyperbolic sub-reflector 55 is enclosed by means of a 0.5 mil mylar shroud 57. The sub-reflector 55, including the screen 65 and the shroud 57 are thermally compression-bonded to the cylindrical tube 61. It is noted here in passing that the requisite inflation tubes for inflating the annular torus 59, the combination of the parabolic main reflector 53 and the truncated, conical shroud 57, and the combination of the hyperbolic sub-reflector 55 and the shroud 57 are not shown for the sake of drawing clarity. They are, however, also fabricated from mylar and therefore do not cause any aperture blockage.

The antenna feed (not shown) is disposed within the cylindrical container 71 which is located at the rear center of the parabolic main reflector 53 and which also contains the dual inflation system (also not shown). Because of the initial angular position uncertainty of the re-entry vehicle 10 (FIG. 4) and the uncertainty involved in attempting to control the antenna pointing direction by the vehicle attitude control system, (not shown) a limited amount (here approximately 3°) of electronic scan is provided in the antenna feed (not shown). It is felt that the requisite antenna beam steering networks are matters involving ordinary skill in the art and, therefore, they will not be recounted here in detail. Suffice it to say here that the antenna feed (not shown) comprises an array of stripline slot radiators (not shown), a diode switch network (not shown), and a variable power divider network (also not shown). In operation, the variable power divider (not shown) and the diode switch network (not shown) are used to control the amplitude taper across selected ones of the stripline slot radiators (not shown), thereby shifting the apparent center of radiation of the feed network (not shown) and providing a degree of beam steering control.

In its stowed condition, the antenna 51 occupies a volume of approximately 200 cubic inches packaged within the cylindrical container 71 which is shown to be mounted on the end of a telescoping deployment arm 75 stowed within a jettisonable canister 73 provided on the rear of the re-entry vehicle 10. When the guidance and navigation computer 31 (FIG. 2) estimates that a sufficient time in flight has elapsed, the control computer 29 (FIGS. 2) generates a command to begin the exo-atmospheric fix-taking sequences Upon receipt of the command, the jettisonable canister 73 is removed (blown away) and the telescoping deployment arm 75 is extended to position the cylindrical container 71 and the antenna 51 to one side of the re-entry vehicle 10. Once the telescoping deployment arm 75 is extended, the antenna 51 is inflated by means of firing igniter controlled valves (not shown) which release the pressurized gas from gas storage bottles (not shown) within the cylindrical container. Once the antenna 51 is inflated, the re-entry vehicle 10 is maneuvered to provide coarse antenna positioning control. At the termination of the exo-atmospheric fix-taking sequence, the deployment arm 75 and, consequently, the antenna 51 are separated from the re-entry vehicle 10.

As mentioned hereinabove, in the endo-atmospheric application, the fix-taking altitudes range between 30K ft. and 5K ft., depending on the plasma layer surrounding the reentry vehicle 10 which, in turn, is dependent on the velocity and reentry angle of the reentry vehicle 10. Due to the order of magnitude reduction in the fix-taking or mapping range, a small aperture antenna may be utilized.

Figure 6A:
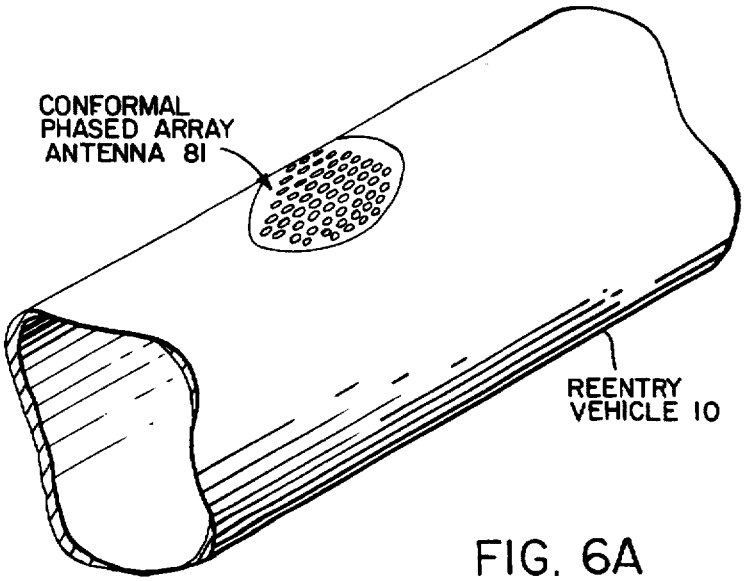
FIGS. 6A, 6B and 6C show an antenna for endo-atmospheric operation.
Figure 6B:
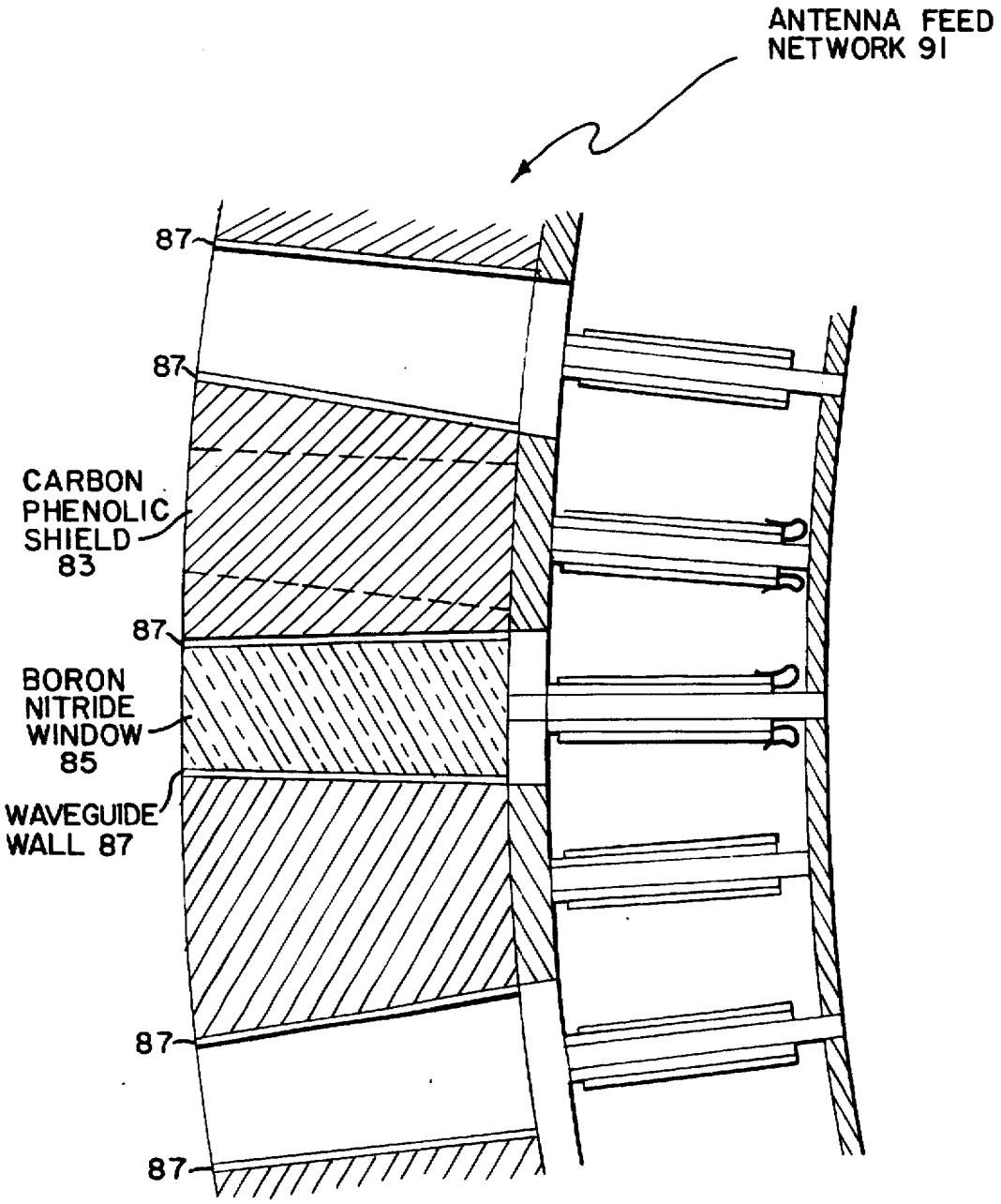
Figure 6C:
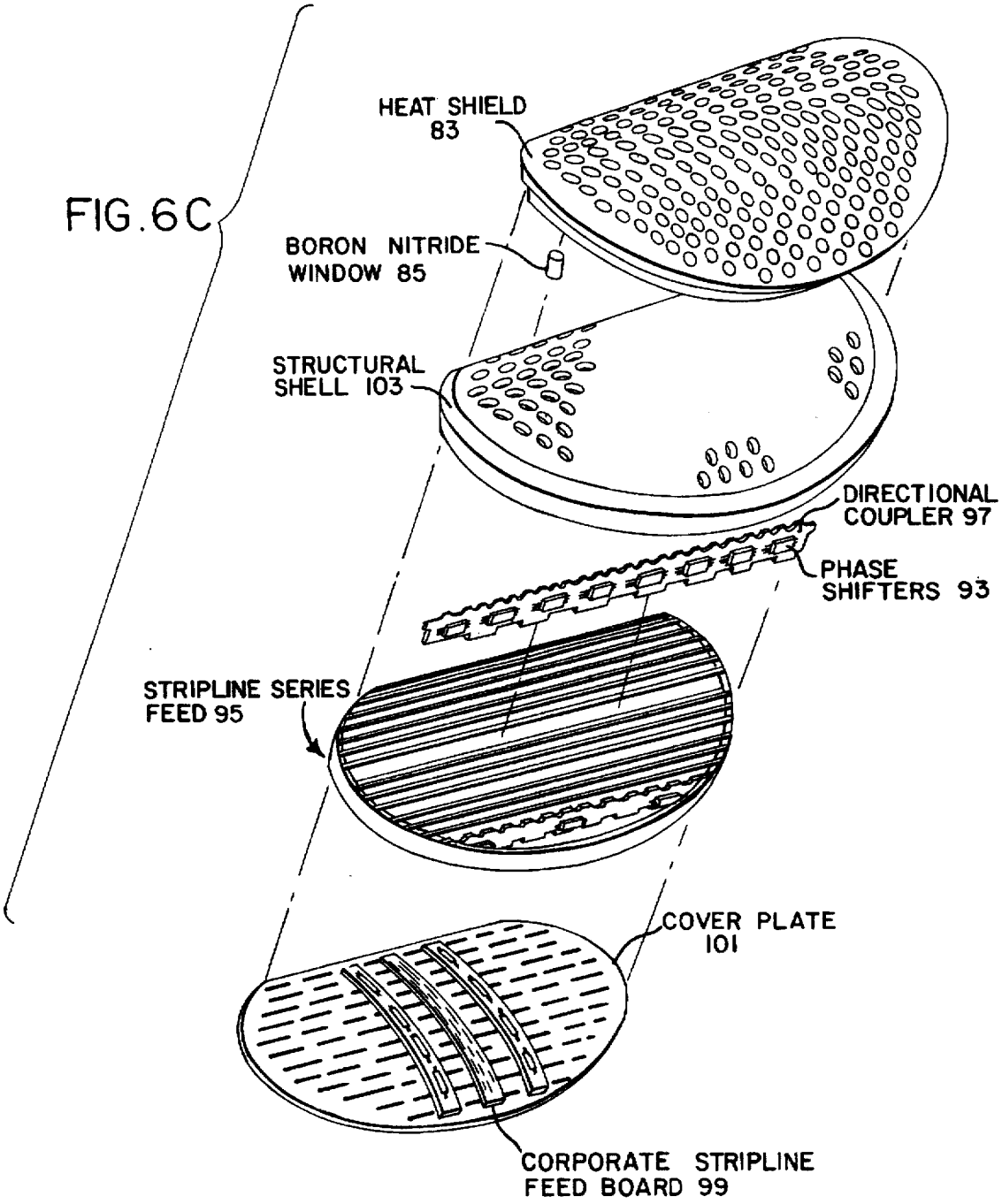

Referring now to FIGS. 6A to 6C, the herein contemplated endo-atmospheric antenna is shown to comprise a conformal phased array antenna 81 (sometimes hereinafter referred to simply as antenna 81) which is located in the aft portion of the re-entry vehicle 10. The antenna 81 is approximately one foot in diameter and contains slightly over 300 radiating elements (not numbered) which are here dielectrically loaded sections of circular waveguide. In forming the radiating elements, holes (not numbered) are machined in the carbon phenolic heat shield 83 and boron nitride antenna windows 85 are inserted therein. The sides of the latter are plated with beryllium to provide a high melt temperature, high conductivity waveguide wall 87. The antenna windows 85 are tapered in width such that their inner surfaces (not numbered) are wider than their outer surfaces (also not numbered), thereby providing a means of mechanical retention. After plating, the antenna windows 85 are bonded to the carbon phenolic heat shield 83 by means of a silicone rubber bonding compound (not shown). The cross-section of the waveguides formed by plating the antenna windows 85 is small enough to allow the propagation of only the two orthogonal $TE_{11}$ fundamental modes, only one of which is excited by the antenna feed network 91.

As in the exo-atmospheric application, electronic beam steering is provided to correct for the angular position uncertainty of the re-entry vehicle 10. However, in the endo-atmospheric application, only vehicle roll will be utilized to point the antenna beam and, therefore, the antenna beam must be scanned over a much greater volume (45° cone about the antenna normal). Hence the antenna feed network 91 includes phase shifters 93 for each of the antenna elements (not numbered). The antenna elements are fed by plurality of stripline series feeds 95 disposed in parallel with the cone generatrix. Coupling to each of the antenna elements (not numbered) is provided by means of directional couplers 97 which eliminate the detrimental effect of internal reflections. The phase shifters 93 for each sequential antenna element (not numbered) are disposed on opposite sides of the stripline series feeds 95 to maximize the available packaging area. The requisite phase shifter drivers (not shown) are packaged with each of the phase shifters 93 also to conserve packaging volume. The stripline series feeds 95 are coupled to a corporate stripline feed board 99 which is disposed orthogonally to the former and is affixed to a cover plate 101 which has a series of slots (not numbered) provided therein in which the stripline series feeds 95 are mounted.

A structural shell 103, which has a lip (not numbered) for engaging the carbon phenolic heat shield 83, is placed around the stripline series feeds 95 and bolted to the cover plate 101 to form the conformal phased array antenna 81 which is inserted into a cavity (not shown) provided in the re-entry vehicle 10. The R.F. energy to and from the antenna, as well as the requisite beam steering commands are supplied via connectors (not shown) provided on the outer surface of the cover plate 101.

Having described an embodiment of this invention, it will now be clear to one of skill in the art that many changes may be made without departing from the inventive concepts. That is to say, details of construction of the contemplated system may be changed without departing from the concept of using a synthetic aperture radar and map-matching techniques to determine the position of any missile with respect to known topographic features and the velocity of such missile to correct an inertial guidance arrangement. It is felt, therefore, that this invention should not be restricted to its disclosed embodiment, but rather should be limited only by the spirit and scope of the appended claims.

What is claimed is:

1. A guidance system for a vehicle approaching a target area on a trajectory determined by an inertial guidance arrangement, such area containing a desired target with a known geographic location with respect to at least three topographic features, each one of such features having a known radar signature, such system comprising:

(a) a pulse Doppler radar carried on the vehicle, such radar being actuable successively to illuminate at least three of the topographic features to provide a corresponding set of radar echo signals;

(b) signal processing and computer means, responsive to the corresponding set of radar echo signals, for providing output signals corresponding to:

(i) the position of the vehicle with respect to the at least three topographic features and the altitude of the vehicle above the target area and, in consequence, the position of the vehicle with respect to the desired target; and (ii) the velocity vector of the vehicle; and (c) means, responsive to the output signals from the signal processing and computer means, for correcting any error in the inertial guidance arrangement to allow such arrangement to guide the vehicle to the desired target.

2. A guidance system as in claim 1 wherein the pulse Doppler radar is operated as a synthetic aperture radar to provide radar echo signals from which a radar map encompassing the at least three topographic features may be generated and the signal processing and computer means includes:

(a) memory means for storing a pre-made radar map of the target area, such map having at least three indicia corresponding to the at least three topographic features;

(b) first comparison means for comparing the generated radar map with the at least three indicia of the stored pre-made radar map to derive location signals indicative of the actual position in space of the vehicle with respect to the target area; and (c) second comparison means for comparing the location signals with corresponding signals from the inertial guidance arrangement to derive correction signals for such arrangement.

* * * * *